US006645314B1

(12) United States Patent
Herzer et al.

(10) Patent No.: US 6,645,314 B1
(45) Date of Patent: Nov. 11, 2003

(54) AMORPHOUS ALLOYS FOR MAGNETO-ACOUSTIC MARKERS IN ELECTRONIC ARTICLE SURVEILLANCE HAVING REDUCED, LOW OR ZERO CO-CONTENT AND METHOD OF ANNEALING THE SAME

(75) Inventors: Giselher Herzer, Bruchkoebel (DE); Nen-Chin Liu, Wellington, FL (US)

(73) Assignees: Vacuumschmelze GmbH, Hanau (DE); Sensormatic Electronics Corp., Boca Raton, FL (US)

( * ) Notice: Subject to any disclaimer, the term of this patent is extended or adjusted under 35 U.S.C. 154(b) by 0 days.

(21) Appl. No.: 09/677,245

(22) Filed: Oct. 2, 2000

(51) Int. Cl.[7] ..... H01F 1/14
(52) U.S. Cl. ..... 148/108; 148/121
(58) Field of Search ..... 148/108, 120, 148/121

(56) References Cited

U.S. PATENT DOCUMENTS

| | | | | |
|---|---|---|---|---|
| 3,820,840 A | | 6/1974 | Berry et al. | |
| 4,053,333 A | * | 10/1977 | Egami et al. | 148/120 |
| 4,284,441 A | * | 8/1981 | Satoh et al. | 148/120 |
| 5,395,460 A | | 3/1995 | Martis | |
| 5,469,140 A | | 11/1995 | Liu et al. | |
| 5,628,840 A | | 5/1997 | Hasegawa | |
| 5,650,023 A | * | 7/1997 | Hasegawa et al. | 148/304 |
| 5,676,767 A | | 10/1997 | Liu et al. | |
| 5,728,237 A | | 3/1998 | Herzer | |
| 5,786,762 A | | 7/1998 | Liu | |
| 5,841,348 A | | 11/1998 | Herzer | |
| 6,011,475 A | * | 1/2000 | Herzer | 148/304 |
| 6,018,296 A | * | 1/2000 | Herzer | 148/108 |
| 6,057,766 A | | 5/2000 | O'Handley et al. | |

FOREIGN PATENT DOCUMENTS

| | | | |
|---|---|---|---|
| EP | 0 093 281 | | 11/1983 |
| WO | WO 90/03652 | | 4/1990 |
| WO | WO 96/32518 | | 10/1996 |
| WO | WO 97/32358 | * | 9/1997 |

OTHER PUBLICATIONS

"Magnetomechanical Properties of Amorphous Metals," Livingston, phys. stat. sol.(a), Vol 70 (1982) pp 591–596.
Magnetomechanical Damping in Amorphous Ribbons with Uniaxial Anisotropy, Herzer, Materials Science and Engineering, A226–228 (1997) pp. 631–635.
"Effects of Longitudinal and Torsional Stress Annealing on the Magnetic Anisotropy in Amorphous Ribbon Materials," Nielsen, IEEE Trans. on Magnetics, vol. MAG–21, No. 5 (1985), pp. 2008–2013.
Stress Induced Magnetic Anisotropy in a Non–Magnetostrictive Amorphous Alloy, Hilzinger, Proc. 4$^{th}$ Int. Conf. on Rapidly Quenched Metals (Sendai, 1981), pp. 791–794.
"Magnetic Anisotropy," Fujimori, from Amorphous Metallic Alloys, Luborsky, Ed. (1983), pp. 300–316.

* cited by examiner

*Primary Examiner*—John Sheehan
(74) *Attorney, Agent, or Firm*—Schiff Hardin & Waite

(57) ABSTRACT

A ferromagnetic resonator for use in a marker in a magnetomechanical electronic article surveillance system is manufactured at reduced cost by being continuously annealed with a tensile stress applied along the ribbon axis and by providing an amorphous magnetic alloy containing iron, cobalt and nickel and in which the portion of cobalt is less than about 4 at %.

14 Claims, 2 Drawing Sheets

AMORPHOUS ALLOYS FOR MAGNETO-ACOUSTIC MARKERS IN ELECTRONIC ARTICLE SURVEILLANCE HAVING REDUCED, LOW OR ZERO CO-CONTENT AND METHOD OF ANNEALING THE SAME

BACKGROUND OF THE INVENTION

1. Field of the Invention

The present invention relates to magnetic amorphous alloys and to a method of annealing such alloys. The present invention is also directed to amorphous magnetostrictive alloys for use in a magnetomechanical electronic article surveillance or identification. The present invention furthermore is directed to a magnetomechanical electronic article surveillance or identification system employing such marker as well as to a method for making the amorphous magnetostrictive alloy and a method for making the marker.

2. Description of the Prior Art

U.S. Pat. No. 3,820,040 teaches that transverse field annealing of amorphous iron based metals yields a large change in Young's modulus with an applied magnetic field and that this effect provides a useful means to achieve control of the vibrational frequency of an electromechanical resonator in combination with an applied magnetic field.

The possibility to control the vibrational frequency by an applied magnetic field was found to be particularly useful in European Application 0 093 281 for markers for use in electronic article surveillance. The magnetic field for this purpose is produced by a magnetized ferromagnetic strip bias magnet disposed adjacent to the magnetoelastic resonator with the strip and the resonator being contained in a marker or tag housing. The change in effective permeability of the marker at the resonant frequency provides the marker with signal identity. The signal identity can be removed by changing the resonant frequency means of changing the applied field. Thus, the marker, for example, can be activated by magnetizing the bias strip, and, correspondingly, can he deactivated by degaussing the bias magnet which removes the applied magnetic field and thus changes the resonant frequency appreciably. Such systems originally (cf European Application 0 0923 281 and PCT Application WO 90/03652) used markers made of amorphous ribbons in the "as prepared" state which also can exhibit an appreciable change in Young's modulus with an applied magnetic field due to uniaxial anisotropies associated with production-inherent mechanical stresses. A typical composition used in markers of this prior art is $Fe_{40}Ni_{38}Mo_4B_{18}$.

U.S. Pat. No. 5,459,140 discloses that the application of transverse field annealed amorphous magnetomechanical elements in electronic article surveillance systems removes a number of deficiencies associated with the markers of the prior art which use as prepared amorphous material. One reason is that the linear hysteresis loop associated with the transverse field annealing avoids the generation of harmonics which can produce undesirable alarms in other types of EAS systems (i.e. harmonic systems). Another advantage of such annealed resonators is their higher resonant amplitude. A further advantage is that the heat treatment in a magnetic field significantly improves the consistency in terms of the resonance frequency of the magnetostrictive strips.

As for example explained by Livingston J. D. 1982 *"Magnetochemical Properties of Amorphous Metals"*, phys. stat sol (a) vol. 70 pp 591–596 and by Herzer G. 1997 *Magnetomechanical damping in amorphous ribbons with uniaxial anisotropy*, Materials Science and Engineering A226–228 p.631 the resonator or properties, such as resonant frequency, the amplitude or the ring-down time are largely determined by the saturation magnetostriction and the strength of the induced anisotropy. Both quantities strongly depend on the alloy composition. The induced anisotropy additionally depends on the annealing conditions i.e. on annealing time and temperature and a tensile stress applied during annealing (cf Fujimori H. 1983 *"Magnetic Anisotropy"* in F. E. Luborsky (ed) *Amorphous Metallic Alloys*, Butterworths, London pp. 300–316 and references therein, Nielsen O. 1985 *Effects of Longitudinal and Torsional Stress Annealing on the Magnetic Anisotropy in Amorphous Ribbon Materials*, IEEE Transitions on Magnetics, vol. Mag-21, No. 5, Hilzinger H. R. 1981 *Stress Induced Anisotropy in a Non-Magnetostrictive Amorphous Alloy*, Proc. $4^{th}$ Int. Conf. on Rapidly Quenched Metals (Sendai 1981) pp. 791). Consequently, the resonator properties depend strongly on these parameters.

Accordingly, aforementioned U.S. Pat. No. 5,469,140 teaches that a preferred material is an Fe—Co-based alloy with at least about 30 at % Co. The high Co-content according to this patent is necessary to maintain a relatively long ring-down period of the signal. German Gebrauchsmuster G 94 12 456.6 teaches that a long ring down time is achieved by choosing an alloy composition which reveals a relatively high induced magnetic anisotropy and that, therefore, such alloys are particularly suited for EAS markers. This Gebrauchsmuster teaches that this also can be achieved at lower Co-contents if starting from a Fe—Co-based alloy, up to about 50% of the iron and/or cobalt is substituted by nickel. The need for a linear B-H loop with a relatively high anisotropy field of at least about 8 Oe and the benefit of allowing Ni in order to reduce the Co-content for such magnetoelastic markers was reconfirmed by the work described in U.S. Pat. No. 5,628,840 which teaches that alloys with an iron content between about 30 at % and below about 45 at % and a Co-content between about 4 at % and about 40 at % are particularly suited. U.S. Pat. No. 5,728,237 discloses further compositions with Co-content lower than 23 at % characterized by a small change of the resonant frequency and the resulting signal amplitude due to changes in the orientation of the marker in the earth's magnetic field, and which at the same time are reliably deactivatable. U.S. Pat. No. 5,841,348 discloses Fe—Co—Ni-based alloys with a Co-content of at least about 12 at % having an anisotropy field of at least about 10 Oe and an optimized ring-down behavior of the signal due to an iron content of less than about 30 at %.

The field annealing in the aforementioned examples was done across the ribbon width i.e. the magnetic field direction was oriented perpendicularly to the ribbon axis (longitudinal axis) and in the plane of the ribbon surface. This type of annealing is known, and will be referred to herein, as transverse field-annealing. The strength of the magnetic field has to be strong enough in order to saturate the ribbon ferromagnetically across the ribbon width. This can be achieved in magnetic fields of a few hundred Oe. U.S. Pat. No. 5,469,140, for example, teaches a field strength in excess of 500 Oe or 800 Oe. PCT Application WO 96/32518 discloses a field strength of about 1 kOe to 1.5 kOe. PCT Applications WO 99/02748 and WO 99/24950 disclose that application of the magnetic field perpendicularly to the ribbon plane enhances (or can enhance) the signal amplitude.

The field-annealing can be performed, for example, batchwise either on toroidally wound cores or on pre-cut straight ribbon strips. Alternatively, as disclosed in detail in European Application EP 0 737 986 (U.S. Pat. No. 5,676,767), the annealing can be performed in a continues mode by transporting the alloy ribbon from one reel to another reel through an oven in which a transverse saturating field is applied to the ribbon.

Typical annealing conditions disclosed in aforementioned patents are annealing temperatures from about 300° C. to 400° C.; annealing times from several seconds up to several hours. PCT Application WO 97/132358, for example, teaches annealing speeds from about 0.3 m/min up to 12 m/min for a 1.8 m long furnace.

Typical functional requirements for magneto-acoustic markers can be summarized as follows:

1. A linear B-H loop up to a minimum applied field of typically 8 Oe.
2. A small susceptibility of the resonant frequency to $f_r$ the applied bias field H in the activated state, i.e., typically $|df_r/dH|<1200$ Hz/Oe.
3. A sufficiently long ring-down time of the signal i.e. a high signal amplitude for a time interval of at least 1–2 ms after the exciting drive field has been switched off.

All these requirements can be fulfilled by inducing a relatively high magnetic anisotropy in a suitable resonator alloy perpendicular to the ribbon axis. This has conventionally been thought to be achievable only when the resonator alloy contains an appreciable amount of Co, i.e. compositions of the prior art like $Fe_{40}Ni_{38}Mo_4B_{18}$, according to U.S. Pat. Nos. 5,469,140 and 5,728,237 and 5,628,840 and 5,841,348 are unsuitable for this purpose. Because of the high raw material cost of cobalt, however, it is highly desirable to reduce its content in the alloy.

Aforementioned PCT application WO 96/32518 also discloses that a tensile stress ranging from about zero to about 70 MPa can be applied during annealing. The result of this tensile stress was that the resonator amplitude and the frequency slope $|df_r/dH|$ either slightly increased, remained unchanged or slightly decreased, i.e. there was no obvious advantage or disadvantage for the resonator properties when applying a tensile stress limited to a maximum of about 70 MPa.

It is well known, however, (cf Nielsen O. 1985 *Effects of Longitudinal and Torsional Stress Annealing on the Magnetic Anisotropyin Amorphous Ribbon Materials*, IEEE Transitions on Magnetics, vol. Mag-21, No.5, Hilzinger H. R. 1981 *Stress Induced Anisotropy in a Non-Magnetostrictive Amorphous Alloy*, Proc. 4$^{th}$ Int. Conf. on Rapidly Quenched Metals (Sendai 1981) pp.791), that a tensile stress applied during annealing induces a magnetic anisotropy. The magnitude of this anisotropy is proportional to the magnitude of the applied stress and depends on the annealing temperature, the annealing time and the alloy composition. Its orientation corresponds either to a magnetic easy ribbon axis or a magnetic hard ribbon axis (-easy magnetic plane perpendicular to the ribbon axis) and thus either decreases or increases the field induced anisotropy, respectively, depending on the alloy composition.

A co-pending application for which one of the present inventors is a co-inventor (Ser. No. 09/133,172, (now U.S. Pat. No. 6,254,695) "Method Employing Tension Control and Lower-Cost Alloy Composition for Annealing Amorphous Alloys with Shorter Annealing Time," Herzer et al., filed Aug. 13, 1998) discloses a method of annealing an amorphous ribbon in the simultaneous presence of a magnetic field perpendicular to the ribbon axis and a tensile stress applied parallel to the ribbon axis. It was found that for compositions with less than about 30 at % iron the applied tensile stress enhances the induced anisotropy. As a consequence, the desired resonator properties could be achieved at lower Co-contents, which in a preferred embodiment range from about 5 at % to 18 at % Co.

SUMMARY OF THE INVENTION

According to the state of the art discussed above, it is highly desirable to provide further means in order to reduce the Co-content of amorphous magneto-acoustic resonators. The present invention is based on the recognition that all this can be achieved by choosing particular alloy compositions having reduced or zero Co-content and by applying a controlled tensile stress along the ribbon during annealing.

It is an object of the present invention to provide a magnetostrictive alloy and a method of annealing such an alloy, in order to produce a resonator having properties suitable for use in electronic article surveillance at lower raw material cost.

It is a further object of the present invention to provide a method of annealing wherein the annealing parameters, in particular the tensile stress, are adjusted in a feed-back process to obtain a high consistency in the magnetic properties of the annealed amorphous ribbon.

It is another object of the present invention to provide such a magnetostrictive amorphous metal alloy for incorporation in a marker in a magnetomechanical surveillance system which can be cut into an oblong, ductile, magnetostrictive strip which can be activated and deactivated by applying or removing a pre-magnetization field H and which, in the activated condition, can be excited by an alternating magnetic field so as to exhibit longitudinal, mechanical resonance oscillations at a resonance frequency $f_r$ which after excitation are of high signal amplitude.

It is a further object of the present invention to provide such an alloy wherein only a slight change in the resonant frequency occurs given a change in the bias field, but wherein the resonant frequency changes significantly when the marker resonator is switched from an activated condition to a deactivated condition.

Another object of the present invention is to provide such an alloy which, when incorporated in a marker for magnetomechanical surveillance system, does not trigger an alarm in a harmonic surveillance system.

It is also an object of the present invention to provide a marker suitable for use in a magnetomechanical surveillance system.

It is an object of the present invention to provide a magnetomechanical electronic article surveillance system which is operable with a marker having a resonator composed of such amorphous magnetostrictive alloy.

The above objects are achieved when the amorphous magnetostrictive alloy is continuously annealed under a tensile stress of at least about 30 MPa up to about 400 MPa and, as an option, with a magnetic field perpendicular to the ribbon axis being simultaneously applied. The alloy composition has to be chosen such that the tensile stress applied during annealing includes a magnetic hard ribbon axis, in other words a magnetic easy plane perpendicular to the ribbon axis. This allows the same magnitude of induced anisotropy to be achieved which, without applying the tensile stress, would only be possible at larger Co-contents and/or slower annealing speeds. Thus the inventive annealing is capable of producing magnetoelastic resonators at lower raw material and lower annealing costs than it is possible with the techniques of the prior art.

For this purpose it is advantageous to choose an Fe—Ni-base alloy with an cobalt content of less than about 4 at %. A generalized formula for the alloy compositions which, when annealed as described above, produces a resonator having suitable properties for use in a marker in a electronic article surveillance or identification system, is as follows:

$$Fe_aCo_bNi_cM_dCu_eSi_xB_yZ_z$$

wherein a, b, c, d, e, x, y and z are in at %, wherein M is one or more of the elements consisting of Mo, Nb, Ta, Cr and V, and Z is one or more of the elements C, P, and Ge and wherein $20 \leqq a \leqq 50$, $0 \leqq b \leqq 4$, $30 \leqq c \leqq 60$, $1 \leqq d \leqq 5$, $0 \leqq e \leqq 2$, $0 \leqq x \leqq 4$, $10 \leqq y \leqq 20$, $0 \leqq z \leqq 3$, and $14 \leqq d+x+y+z \leqq 25$, such that $a+b+c+d+e+x+y+z=100$.

In a preferred embodiment the group out of which M is selected is restricted to Mo, Nb and Ta only and the following ranges apply:

$30 \leqq a \leqq 45$, $0 \leqq b \leqq 3$, $30 \leqq c \leqq 55$, $1 \leqq d \leqq 4$, $0 \leqq e \leqq 1$, $0 \leqq x \leqq 3$, $14 \leqq y \leqq 18$, $0 \leqq z \leqq 2$, and $15 \leqq d+x+y+z \leqq 22$.

Examples for such particularly suited alloys for EAS applications are $Fe_{33}Co_2Ni_{43}Mo_2B_{20}$, $Fe_{35}Ni_{43}Mo_4B_{18}$, $Fe_{36}Co_2Ni_{44}Mo_2B_{16}$, $Fe_{36}Ni_{46}Mo_2B_{16}$, $Fe_{40}Ni38Mo_3Cu_1B_{18}$, $Fe_{40}Ni_{38}Mo_4B_{18}$, $Fe_{40}Ni_{40}Mo_4B_{16}$, $Fe_{40}Ni_{38}Nb_4B_{18}$, $Fe_{40}Ni_{40}Mo_2Nb_2B_{16}$, $Fe_{41}Ni_{41}Mo_2B_{16}$, $Fe_{45}Ni_{33}Mo_4B_{18}$.

In another preferred embodiment the group out of which M is selected is restricted to Mo, Nb and Ta only and the following ranges apply:

$20 \leqq a \leqq 30$, $0 \leqq b \leqq 4$, $45 \leqq c \leqq 60$, $1 \leqq d \leqq 3$, $0 \leqq e \leqq 1$, $0 \leqq x \leqq 3$, $14 \leqq y \leqq 18$, $0 \leqq z \leqq 2$, and $15 \leqq d+x+y+z \leqq 20$.

Examples of such compositions are $Fe_{30}Ni_{52}Mo_2B_{16}$, $Fe_{30}Ni_{52}Nb_1Mo_1B_{16}$, $Fe_{29}Ni_{52}Nb_1Mo_1Cu_1B_{16}$, $Fe_{28}Ni_{54}Mo_2B_{16}$, $Fe_{28}Ni_{54}Nb_1Mo_1B_{16}$, $Fe_{26},Ni_{56}Mo_2B_{16}$, $Fe_{26}Ni_{54}Co_2Mo_2B_{16}$, $Fe_{24}Ni_{56}Co_2Mo_2B_{16}$ and other similar cases.

Such alloy compositions are characterized by an increase of the induced anisotropy field $H_k$ when a tensile stress $\sigma$ is applied during annealing which is at least about $dH_k/d\sigma \approx 0.02$ Oe/MPa when annealed for 6 s at 360° C.

The suitable alloy compositions have a saturation magnetostriction of more than about 3 ppm and less than about 20 ppm. Particularly suited resonators, when annealed as described above, have an anisotropy field $H_k$ between about 6 Oe and 14 Oe, with $H_k$ being correspondingly lower as the saturation magnetostriction is lowered. Such anisotropy fields are high enough so that the active resonators exhibit only a relatively slight change in the resonant frequency $f_r$ given a change in the magnetization field strength i.e. $|df/dH|<1200$ Hz/Oe, but at the same time the resonant frequency $f_r$ changes significantly by at least about 1.6 kHz when the marker resonator is switched from an activated condition to a deactivated condition. In a preferred embodiment such a resonator ribbon has a thickness less than about 30 $\mu$m, a length at about 35 mm to 40 mm and a width less then about 13mm preferably between about 4 mm to 8 mm i.e., for example, 6 mm.

The annealing process results in a hysteresis loop which is linear up to the magnetic field where the magnetic alloy is saturated ferromagnetically. As a consequence, when excited in an alternating field the material produces virtually no harmonics and, thus, does not trigger alarm in a harmonic surveillance system.

The variation of the induced anisotropy and the corresponding variation of the magneto-acoustic properties with tensile stress can also be advantageously used to control the annealing process. For this purpose the magnetic properties (e.g. the anisotropy field, the permeability or the speed of sound at a given bias) are measured after the ribbon has passed the furnace. During the measurement the ribbon should be under a predefined stress or preferably stress free which can be arranged by a dead loop. The result of this measurement may be corrected to incorporate the demagnetizing effects as they occur on the short resonator. If the resulting test parameter deviates from its predetermined value, the tension is increased or decreased to yield the desired magnetic properties. This feedback system is capable to effectively compensate the influence of composition fluctuations, thickness fluctuations and deviations from the annealing time and temperature on the magnetic and magnetoelastic properties. The results are extremely consistent and reproducible properties of the annealed ribbon which else are subject to relatively strong fluctuations due to said influence parameters.

DESCRIPTION OF THE PREFERRED EMBODIMENTS

EAS System

Figure 3:
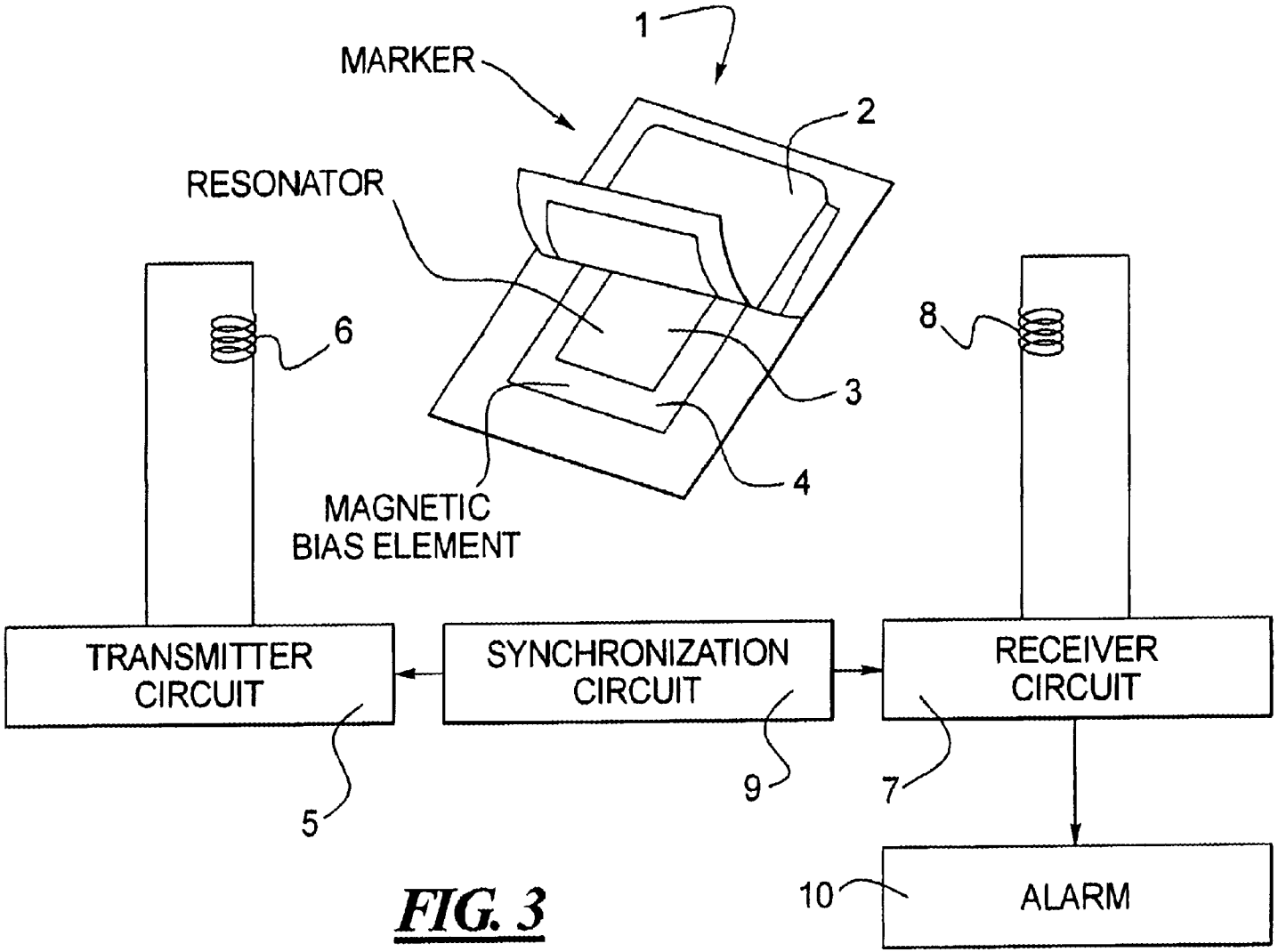
FIG. 3 shows a marker, with the upper part of its housing partly pulled away to show internal components, having a resonator made in accordance with the principles of the present invention, in the context of a schematically illustrated magnetomechanical article surveillance system.

The magnetomechanical surveillance system shown in FIG. 3 operates in a known manner. The system, in addition to the marker 1, includes a transmitter circuit 5 having a coil or antenna 6 which emits (transmits) RF bursts at a predetermined frequency, such as 58 kHz, at a repetition rate of, for example, 60 Hz, with a pause between successive bursts. The transmitter circuit 5 is controlled to emit the aforementioned RF bursts by a synchronization circuit 9, which also controls a receiver circuit 7 having a reception coil or antenna 8. If an activated marker 1 (i.e., a marker having a magnetized bias element 4) is present between the coils 6 and 8 when the transmitter circuit 5 is activated, the RF burst emitted by the coil 6 will drive the resonator 3 to oscillate at a resonant frequency of 58 kHz (in this example), thereby generating a signal having an initially high amplitude, which decays exponentially.

The synchronization circuit 9 controls the receiver circuit 7 so as to activate the receiver circuit 7 to look for a signal at the predetermined frequency 58 kHz (in this example) within first and second detection windows. Typically, the synchronization circuit 9 will control the transmitter circuit 5 to emit an RF burst having a duration of about 1.6 ms, in which case the synchronization circuit 9 will activate the receiver circuit 7 in a first detection window of about 1.7 ms duration which begins at approximately 0.4 ms after the end of the RF burst. During this first detection window, the receiver circuit 7 integrates any signal at the predetermined frequency, such as 58 kHz, which is present. In order to produce an integration result in this first detection window which can be reliably compared with the integrated signal from the second detection window, the signal emitted by the marker 1, if present, should have a relatively high amplitude.

When the resonator 3 made in accordance with the invention is driven by the transmitter circuit 5 at 18 mOe, the receiver coil 8 is a close-coupled pick-up coil of 100 turns, and the signal amplitude is measured at about 1 ms after an a.c. excitation burst of about 1.6 ms duration, it produces an amplitude of at least 1.5 nWb in the first detection window. In general, $A1 \propto N \cdot W \cdot H_{ac}$ wherein N is the number of turns of the receiver coil, W is the width of the resonator and $H_{ac}$ is the field strength of the excitation (driving) field. The specific combination of these factors which produces A1 is not significant.

Subsequently, the synchronization circuit 9 deactivates the receiver circuit 7, and then re-activates the receiver circuit 7 during a second detection window which begins at approximately 6 ms after the end of the aforementioned RF burst. During the second detection window, the receiver circuit 7 again looks for a signal having a suitable amplitude at the predetermined frequency (58 kHz). Since it is known that a signal emanating from a marker 1, if present, will have a decaying amplitude, the receiver circuit 7 compares the amplitude of any 58 kHz signal detected in the second detection window with the amplitude of the signal detected in the first detection window. If the amplitude differential is consistent with that of an exponentially decaying signal, it is assumed that the signal did, in fact, emanate from a marker 1 present between the coils 6 and 8, and the receiver circuit 7 accordingly activates an alarm 10.

This approach reliably avoids false alarms due to spurious RF signals from RF sources other than the marker 1. It is assumed that such spurious signals will exhibit a relatively constant amplitude, and therefore even if such signals are integrated in each of the first and second detection windows, they will fail to meet the comparison criterion, and will not cause the receiver circuit 7 to trigger the alarm 10.

Moreover, due to the aforementioned significant change in the resonant frequency $f_r$ of the resonator 3 when the bias field $H_b$ is removed, which is at least 1.2 kHz, it is assured that when the marker 1 is deactivated, even if the deactivation is not completely effective, the marker 1 will not emit a signal, even if excited by the transmitter circuit 5, at the predetermined resonant frequency, to which the receiver circuit 7 has been tuned.

Alloy Preparation

Amorphous metal alloys within the Fe—Co—Ni—M—Cu—Si—B where M=Mo, Nb, Ta, Cr system were prepared by rapidly quenching from the melt as thin ribbons typically 20 $\mu$m to 25 $\mu$m thick. Amorphous hereby means that the ribbons revealed a crystalline fraction less than 50%. Table 1 lists the investigated compositions and their basic properties. The compositions are nominal only and the individual concentrations may deviate slightly from this nominal values and the alloy may contain impurities like carbon due to the melting process and the purity of the raw materials. Moreover, up to 1.5 at % of boron, for example, may be replaced by carbon.

All casts were prepared from ingots of at least 3 kg using commercially available raw materials. The ribbons used for the experiments were 6 mm wide and were either directly cast to their final width or slit from wider ribbons. The ribbons were strong, hard and ductile and had a shiny top surface and a somewhat less shiny bottom surface.

Annealing

The ribbons were annealed in a continuous mode by transporting the alloy ribbon from one reel to another reel through an oven by applying a tensile force along the ribbon axis ranging from about 0.5 N to about 20 N.

Simultaneously a magnetic field of about 2 kOe, produced by permanent magnets, was applied during annealing perpendicular to the long ribbon axis. The magnetic field was oriented either transverse to the ribbon axis, i.e. across the ribbon width according to the teachings of the prior art, or the magnetic field was oriented such that it revealed substantial component perpendicular to the ribbon plane. The latter technique provides the advantages of higher signal amplitudes. In both cases the annealing field is perpendicular to the long ribbon axis.

Although the majority of the examples given in the following were obtained with the annealing field oriented essentially perpendicular to the ribbon plane, the major conclusions apply as well to the conventional "transverse" annealing and to annealing without the presence of a magnetic field.

The annealing was performed in ambient atmosphere. The annealing temperature was chosen within the range from about 300° C. to about 420° C. A lower limit for the annealing temperature is about 300° C. which is necessary to relieve part of the production of inherent stresses and to provide sufficient thermal energy in order to induce a magnetic anisotropy. An upper limit for the annealing temperature results from the crystallization temperature. Another upper limit for the annealing temperature results from the requirement that the ribbon be ductile enough after the heat treatment to be cut into short strips. The highest annealing temperature preferably should be lower than the lowest of these material characteristic temperatures. Thus, typically, the upper limit of the annealing temperature is around 420° C.

The furnace used for treating the ribbon was about 40 cm long with a hot zone of about 20 cm in length where the ribbon was subject to said annealing temperature. The annealing speed was 2 m/min which corresponds to an annealing time of about 6 sec.

The ribbon was transported through the oven in a straight way and was supported by an elongated annealing fixture in order to avoid bending to twisting of the ribbon due to the forces and the torque exerted to the ribbon by the magnetic field.

Testing

The annealed ribbon was cut to short pieces, typically 38 mm long. These samples were used to measure the hysteresis loop and the magnetoelastic properties. For this purpose, two resonator pieces were put together to form a dual resonator. Such a dual resonator essentially has the same properties as a single resonator of twice the ribbon width, but has the advantage of a reduced size (cf Herzer co-pending application Ser. No. 09/247,688 filed Feb. 10, 1999, now U.S. Pat. No. 6,359,563 "Magneto-Acoustic Marker for Electronic Surveillance Having Reduced Size and High Amplitude"). Although using this from of a resonator in the present examples, the invention is not limited to this special type of resonator, but applies also to other types at resonators (single or multiple) having a length between about 20 mm and 100 mm and having a width between about 1 and 15 mm.

The hysteresis loop was measured at a frequency of 60 Hz in a sinusoidal field of about 30 Oe peak amplitude. The anisotropy field is the defined as the magnetic field $H_k$ up to which the B-H loop shows a linear behavior and at which the magnetization reaches its saturation value. For an easy magnetic axis (or easy plane) perpendicular to the ribbon axis the transverse anisotropy field is related to anisotropy constant $K_u$ by $$H_k=2K_u/J_s$$

where $J_s$ is the saturation magnetization $K_u$ is the energy needed per volume unit to turn the magnetization vector from the direction parallel to the magnetic easy axis to a direction perpendicular to the easy axis.

The anisotropy field is essentially composed of two contributions, i.e.

$$H_k=H_{demag}+H_a$$

where $H_{demag}$ is due to demagnetizing effects and $H_a$ characterizes the anisotropy induced by the heat treatment. The pre-requirement for reasonable resonator properties is that $H_a>0$ which is equivalent to $H_k>H_{demag}$. The demagnetizing field of the investigated 38 mm long and 6 mm wide dual resonator samples typically was $H_{demag}$ 3–3.5 Oe.

The magneto-acoustic properties such as the resonant frequency $f_r$ and the resonant amplitude A1 were determined as a function of a superimposed d.c. bias field H along the ribbon axis by exciting longitudinal resonant vibrations with tone bursts of a small alternating magnetic field oscillating at the resonant frequency with a peak amplitude of about 18 mOe. The on-time of the burst was about 1.6 ms with a pause of about 18 ms in between the bursts.

The resonant frequency of the longitudinal mechanical vibration of an elongated strip is given by $$f_r=(\tfrac{1}{2}L)\sqrt{E_H/\rho}$$

where L is the sample length $E_H$ is Young's modulus at the bias field H and ρ is the mass density. For the 38 mm long samples the resonant frequency typically was in between about 50 kHz and 60 kHz depending on the bias field strength.

The mechanical stress associated with the mechanical vibration, via magnetoelastic interaction, produces a periodic change of the magnetization J around its average value $J_H$ determined by the bias field H. The associated change of magnetic flux induces an electromagnetic force (emf) which was measured in a close-coupled pickup coil around the ribbon with about 100 turns.

In EAS systems the magneto-acoustic response of the marker is advantageously detected in between the tone bursts which reduces the noise level and, thus, for example allows to build wider gates. The signal decays exponentially after the excitation i.e. when the tone burst is over. The decay (or "ring-down") time depends on the alloy composition and the heat treatment and may range from about a few hundred microseconds up to several milliseconds. A sufficiently long decay time of at least about 1 ms is important to provide sufficient signal identity in between the tone bursts.

Therefore the induced resonant signal amplitude was measured about 1 ms after the excitation; this resonant signal amplitude will be referred to as A1 in the following. A high A1 amplitude as measured here, thus, is an indication of both good magneto-acoustic response and low signal attenuation at the same time.

In order to characterize the resonator properties the following characteristic parameters of the $f_r$ vs. $H_{bias}$ curve have been evaluated.

- $H_{max}$ the bias field where the A1 amplitude reveals its maximum
- A1 $H_{Hmax}$ the A1 amplitude at $H=H_{max}$
- $t_{R.Hmax}$ the ring-down time at $H_{max}$, i.e the time interval during which the signal decreases to about 10% of its initial value.
- $|df_r/dH|$ the slope of $f_r(H)$ at $H=H_{max}$
- $H_{min}$ the bias field where the resonant frequency $f_r$ reveals its minimum, i.e. where $|df_r/dH|=0$
- $A1_{Hmin}$ the A1 amplitude at $H=H_{min}$
- $t_{R.Hmin}$ the ring-down time at $H_{min}$ i.e the time interval during which the signal decreases to about 10% of its initial value.

Results

Table II lists the properties of an amorphous $Fe_{40}Ni_{38}MO_4B_{18}$ alloy as used in the as cast state for conventional magneto-acoustic markers. The disadvantage in the as cast state is a non-linear B-H loop which triggers an unwanted alarm in harmonic systems. The latter deficiency can be overcome by annealing in a magnetic field perpendicular to the ribbon axis which yields a linear B-H loop. However, after such a conventional heat treatment the resonator properties degrade appreciably. Thus, the ring-down time of the signal decreases significantly which results in a low A1 amplitude. Furthermore the slope $|df_r/dH|$ at the bias field $H_{max}$ where the A1 amplitude has its maximum increases to undesirably high values of several thousands Hz/Oe.

The present inventors have found that the above-mentioned difficulties can be overcome if a tensile force of e.g. 20 N is applied during annealing. This tensile force can be applied in addition to the magnetic field or instead of the magnetic field. In either case the result for the same $Fe_{40}Ni38Mo_4B_{18}$ is a linear B-H loop with excellent resonator properties which are listed in Table III. Compared to the pure field annealing the annealing under tensile stress yields high signal amplitudes A1 (indicative of a long ring-down time) which significantly exceed those of the conventional marker using the as cast alloy. As well the stress annealed samples exhibit suitably low slope below about 1000 Hz/Oe.

Another example is given in Table IV for an $Fe_{40}Ni_{40}Mo_4B_{16}$ alloy. Again a tensile force during annealing significantly improves the resonator properties (i e. higher amplitude and lower slope) compared to the magnetic field annealed sample. The anisotropy field $H_k$ increases linearly with the applied tensile stress i.e.

$$H_k = H_k(\sigma = 0) + \frac{dH_k}{d\sigma}\sigma$$

whereby the tensile stress σ and the tensile force F are related by $$\sigma = \frac{F}{t \cdot w}$$

where t is the ribbon thickness and w is the ribbon width (example: For a 6 mm wide and 25 μm in thick ribbon a tensile force of 10 N corresponds to a tensile stress of 67 MPa).

Figure 1:
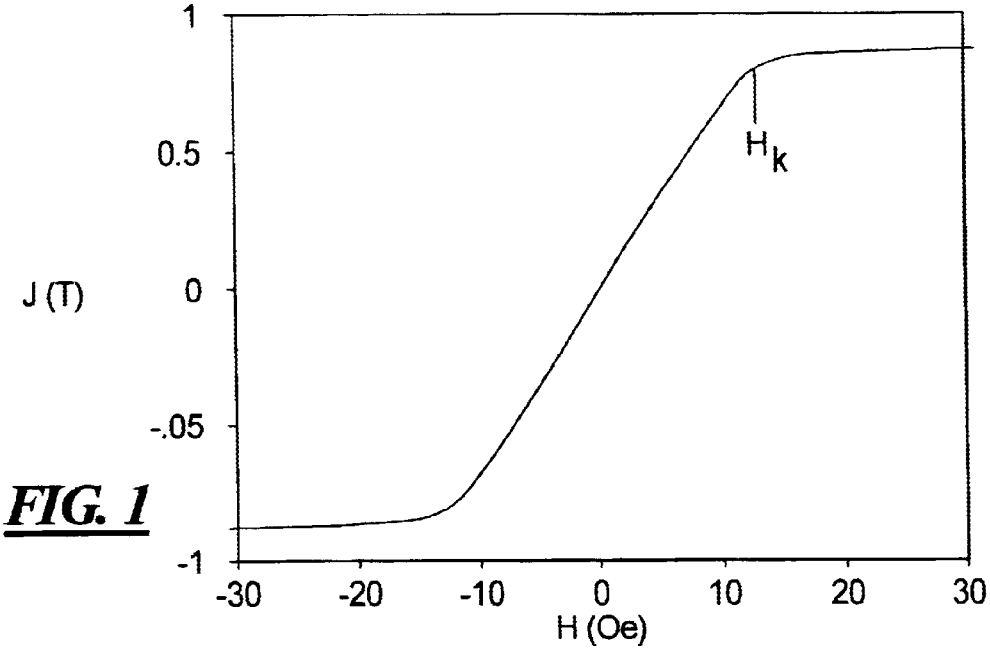
FIG. 1 shows a typical hysteresis loop for an amorphous ribbon annealed under tensile stress and or in a magnetic field perpendicular to the ribbon axis. The particular example shown in FIG. 1 is an embodiment at this invention and corresponds to a dual resonator prepared from two 38 mm long, 6 mm wide and a 25 $\mu$m thick strips consecutively cut from an amorphous $Fe_{40}Ni_{40}Mo_4B_{16}$ alloy ribbon which has been continuously annealed with a speed of 2 m/min (annealing time about 6 s) at 360° C. under the simultaneous presence of a magnetic field of 2 kOe oriented substantially perpendicularly to the ribbon plane and a tensile force at about 19 N.
Figure 2:
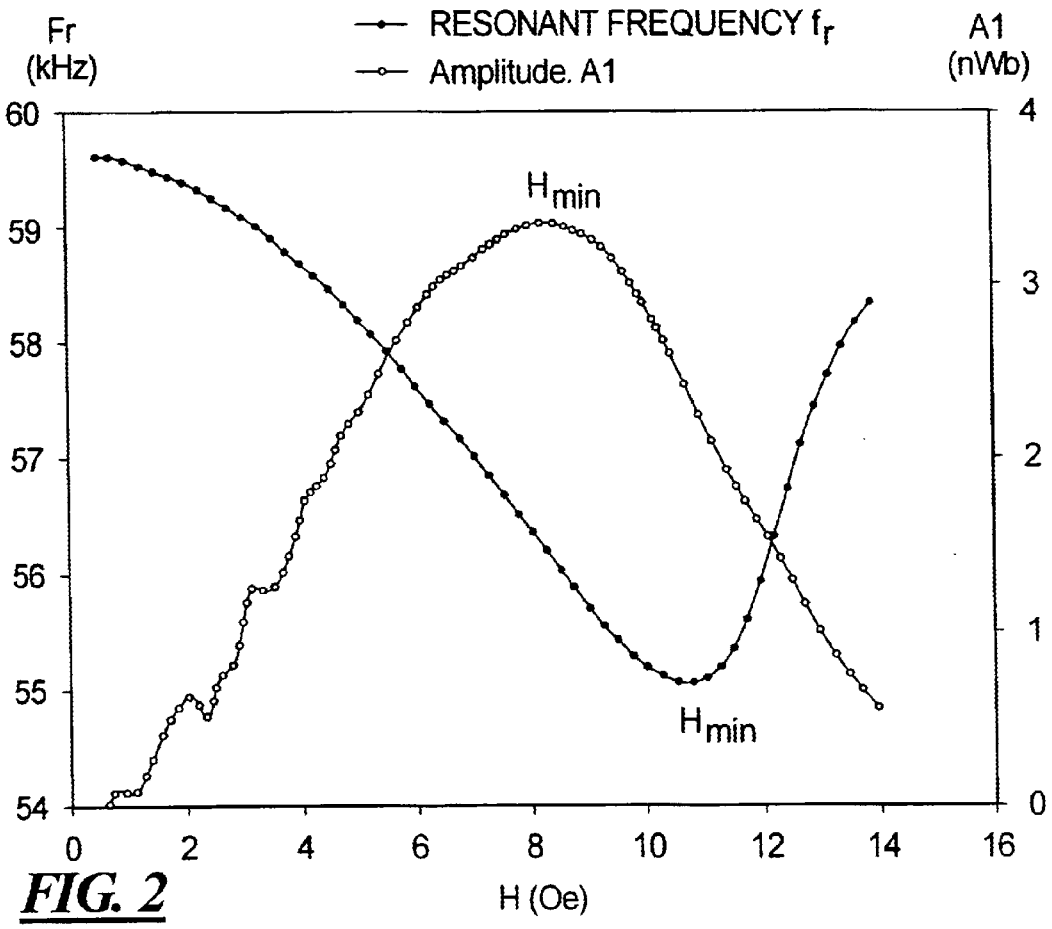
FIG. 2 shows the typical behavior at the resonant frequency $f_r$ and the resonant amplitude A1 as a function of a magnetic bias field H for an amorphous magnetostrictive ribbon annealed under tensile stress and/or in a magnetic field perpendicular to the ribbon axis. The particular example shown in FIG. 2 is an embodiment of this invention and corresponds to a dual resonator prepared from two 38 mm long, 6 mm wide and a 25 $\mu$m thick strips consecutively cut from an amorphous $Fe_{40}Ni_{40}Mo_4B_{16}$ alloy ribbon which has been continuously annealed with a speed of 2 m/min (annealing time about 6 s) at 360° C., under the simultaneous presence at a magnetic field of 2 kOe oriented substantially perpendicularly to the ribbon plane and a tensile force at about 19 N.

As an example, FIG. 1 shows the typical linear hysteresis loop characteristic for the resonators annealed according to present invention. The corresponding magneto-acoustic response is given in FIG. 2. The figures are meant to illustrate the basic mechanisms affecting the magneto-acoustic properties of a resonator. Thus, the variation of the resonant frequency $f_r$ with the bias field H, as well as the corresponding variation of the resonant amplitude A1 is strongly correlated with the variation of the magnetization J with the magnetic field. Accordingly, the bias field $H_{min}$ where $f_r$ has its minimum is located close to the anisotropy field $H_k$. Moreover, the bias field $H_{max}$ where the amplitude is maximum also correlates with the anisotropy field $H_k$. For the inventive examples typically $H_{max} \approx 0.4$–$0.8\ H_k$ and $H_{min} \approx 0.8$–$0.9\ H_k$. Furthermore, the slope $|df_r/dH|$ decreases with increasing anisotropy field $H_k$. Moreover a high $H_k$ is beneficial for the signal amplitude A1 since the ring-down time is significantly increasing with $H_k$ (cf Table IV). Suitable resonator properties are found when the anisotropy field $H_k$ exceeds about 6–7 Oe.

The dependence of the resonator properties on the tensile stress can be used to tailor specific resonator properties by appropriate choice of the stress level. In particular, the tensile force can be used to control the annealing process in a closed loop process. For example, if $H_k$ is continuously measured after annealing the result can be fed back to adjust the tensile stress order to obtain the desired resonator properties in a most consistent way.

It is evident from the results discussed so far that stress annealing only gives a benefit if the anisotropy field $H_k$ increases with the annealing stress, i.e. if $dH_k/d\sigma>0$. This has been found to be the case in Fe—Co—Ni—Si—B type amorphous alloys if the iron content is less than about 30 at % (cf co-pending application Ser. No 09/133,172 filed on Aug. 13, 1998 now U.S. Pat. No. 6,254,695). Table V lists the results for some of these comparative examples (alloys No 1 and 2 from Table I). The results shown for alloy no. 1 and 2 are typical of linear resonators as they are presently used in markers for electronic article surveillance co-pending applications Ser. No 09/133,172 now U.S. Pat. No. 6,254,695 and Ser. No, 09/247,688 now U.S. Pat. No. 6,359,695). These alloys, however, are beyond the scope of the present invention because they have an appreciable Co-content of more than about 10 at % which increases raw material cost.

Further examples beyond the scope of this invention are given by alloy no. 3 and 4 of Table I. As evidenced in Table V alloy no. 3 has a negative value of $dH_k/d\sigma$ i.e. stress annealing results in unsuitable resonator properties (low ring-down time and, as a consequence, a low amplitude for this example). Alloy no. 4 is unsuitable because it has a non-linear B-H loop even after annealing.

Table VI lists further inventive examples (alloys 5 thru 21 from Table I). All these examples exhibit a significant increase of $H_k$ by annealing under stress ($dH_k/d\sigma>0$) and, as a consequence, suitable resonator properties in terms of a reasonably low slope at $H_{max}$ and a high level of signal amplitude A1. These alloys are characterized by an iron content larger than about 30 at %, a low or zero Co-content and apart from Fe, Co, Ni, Si and B contain at least one element chosen from group Vb and/or VIb of the periodic table such as Mo, Nb and/or Cr. In particular the latter circumstance is responsible that $dH_k/d\sigma>0$ i.e. that the resonator properties can be significantly improved by tensile stress annealing to suitable values although the alloys contain no or a negligible amount of Co. The benefit of these group Vb and/or VIb elements becomes most evident when comparing the suitable alloys 5 through 21 e.g. with alloy no. 3 ($Fe_{40}Ni_{38}Si_4B_{18}$)

Alloys no. 7 thru 21 are particularly suitable since they reveal a slope of less than 1000 Hz/Oe at $H_{max}$. Obviously the use of Mo and Nb is more effective to reduce the slope than adding only Cr. Furthermore decreasing the B-content is also beneficial for the resonator properties.

In all the examples given in Table VI a magnetic field perpendicular to the ribbon plane has been applied in addition to the tensile stress. Yet similar results are obtainable without the presence of the magnetic field. This may be advantageous in view of the investment for the annealing equipment (no need for expensive magnets). Another advantage of stress annealing is that the annealing temperature may be higher than the Curie temperature of the alloy (in this case magnetic field annealing induces no anisotropy or only a very low anisotropy) which facilitates alloy optimization. Yet, on the other hand, the simultaneous presence of a magnetic field provides the advantage to reduce the stress magnitude needed to achieve the desired resonator properties.

One problem that arises with alloys containing a high amount of Mo of about 4 at % is these alloys tend to exhibit difficulties in casting. These difficulties are largely removed when the Mo-content is reduced to about 2 at % and/or replaced by Nb. A lower Mo and/or Nb-content, moreover, reduces raw material cost, however, the reduction in Mo reduces the sensitivity to the annealing stress and results e.g. in a higher slope. This may be a disadvantage if a slope of less than about 600–700 Hz/Oe is necessary for the resonator. The slope enhancement effect of a reduced Mo-content can be compensated by reducing the Fe-content toward 30 at % and below. This is demonstrated by the alloy series $Fe_{30-x}Ni_{52+x}Mo_2B_{16}$ (x=0, 2, 4 and 6 at %) which corresponds to examples 18 through 21 in Tables I and VI, respectively. These low iron content alloys have a very high sensitivity to tensile stress annealing i.e. $dH_k/d\sigma \geqq 0.050$ Oe/MPa, which at higher Fe-contents is only achievable with a considerably higher content in Mo and/or Nb (cf examples 13 and 15 in Table I and Table VI, respectively). Accordingly, stress annealing of these low iron-content alloys results in a low slope of significantly less than 700 Hz/Oe which results in particularly suitable resonators. The sensitivity to the annealing stress $dH_k/d\sigma$ is even so high such that no additional magnetic field induced anisotropy is needed for a low slope. (It should be noted that the Curie temperature of these alloys ranges from about 230° C. to about 310° C. and is much lower than the annealing temperature. Accordingly, the magnetic field induced anisotropy is negligible in the present investigations.) Consequently, these low iron content alloys are preferable because they also yield a suitably low slope without the simultaneous presence of a magnetic field during annealing, which significantly reduces the cost for the annealing equipment.

In summary low iron content and low Mo/Nb-content alloy compositions like $Fe_{30+x}Ni_{52-y-x}Co_yMo_2B_{16}$ or $Fe_{30+}$ $xNi_{52-y-x}Co_yMo_1B_{16}$ with x=−10 to 3, y=0 to 4 are particularly suitable because of their good castability, reduced raw material cost and their high susceptibility to stress annealing (i.e. $dH_k/d\sigma \geqq 0.05$ Oe/MPa when annealed for 6 s at 360° C.), which results in a particularly low slope at moderate annealing stress magnitudes even if no additional magnetic field is applied. All of these factors contribute to a reduced investment for annealing equipment.

TABLE I

Investigated alloy compositions and their basic magnetic properties ($J_s$ saturation magnetization $\lambda_s$ saturation magnetostriction, $T_c$ Curie temperature)

| No | Composition (at %) | $J_s$ (T) | $\lambda_s$ (ppm) | $T_c$ (° C.) |
|---|---|---|---|---|
| 1 | $Fe_{24}Co_{12.5}Ni_{45.5}Si_2B_{16}$ | 0.86 | 11.4 | 388 |
| 2 | $Fe_{24}Co_{11}Ni_{47}Mo_1Si_{0.5}B_{16.5}$ | 0.82 | 10.2 | 353 |
| 3 | $Fe_{40}Ni_{38}Si_4B_{16}$ | 0.96 | 14.9 | 362 |
| 4 | $Fe_{40}Ni_{38}B_{22}$ | 0.99 | 15.1 | 360 |
| 5 | $Fe_{40}Ni_{38}Mo_2B_{20}$ | 0.93 | 14.7 | 342 |
| 6 | $Fe_{40}Ni_{38}Cr_4B_{18}$ | 0.89 | 14.5 | 333 |
| 7 | $Fe_{33}Co_2Ni_{43}Mo_2B_{20}$ | 0.81 | 11.1 | 293 |
| 8 | $Fe_{35}Ni_{43}Mo_4B_{18}$ | 0.84 | 12.6 | 313 |
| 9 | $Fe_{36}Co_2Ni_{44}Mo_2B_{16}$ | 0.96 | 16.4 | 374 |
| 10 | $Fe_{36}Ni_{46}Mo_2B_{16}$ | 0.94 | 16.0 | 358 |
| 11 | $Fe_{40}Ni_{38}Mo_3Cu_1B_{18}$ | 0.94 | 15.0 | 346 |
| 12 | $Fe_{40}Ni_{38}Mo_4B_{18}$ | 0.90 | 13.9 | 328 |
| 13 | $Fe_{40}Ni_{40}Mo_4B_{16}$ | 0.91 | 15.0 | 341 |
| 14 | $Fe_{40}Ni_{38}Nb_4B_{18}$ | 0.85 | 13.2 | 314 |
| 15 | $Fe_{40}Ni_{40}Mo_2Nb_2B_{16}$ | 0.91 | 15.1 | 339 |
| 16 | $Fe_{41}Ni_{41}Mo_2B_{16}$ | 1.04 | 19.0 | 393 |
| 17 | $Fe_{45}Ni_{33}Mo_4B_{18}$ | 0.97 | 15.8 | 347 |
| 18 | $Fe_{30}Ni_{52}Mo_2B_{16}$ | 0.80 | 12.1 | 309 |
| 19 | $Fe_{28}Ni_{54}Mo_2B_{16}$ | 0.75 | 108 | 288 |
| 20 | $Fe_{26}Ni_{56}Mo_2B_{16}$ | 0.70 | 92 | 261 |
| 21 | $Fe_{24}Ni_{68}Mo_2B_{16}$ | 0.64 | 7.9 | 229 |

TABLE II (PRIOR ART)

Magneto-acoustic properties of $Fe_{40}Ni_{38}Mo_4B_{18}$ in the as cast state and after annealing for 6 s at 360° C. in a magnetic field oriented across the ribbon width (transverse field) and oriented perpendicular to the ribbon plane (perpendicular field).

| annealing conditions | $H_k$ (Oe) | Hmax (Oe) | $A1_{Hmax}$ (nWb) | $\lvert df_r/dH \rvert$ (Hz/Oe) | $H_{min}$ (Oe) | $A1_{Hmin}$ (nWb) |
|---|---|---|---|---|---|---|
| none (as cast) | (*) | 4.3 | 2.2 | 145 | 4.8 | 2.1 |
| transverse field | 40 | 5.3 | 0.9 | 2612 | 3.8 | 0.5 |
| perpendicular field | 43 | 5.0 | 1.2 | 3192 | 3.6 | 1.1 |

(*) non-linear B-H loop

TABLE III

Magneto-acoustic properties of $Fe_{40}Ni_{38}Mo_4B_{18}$ after annealing for 6 s at 360° C. under a tensile force of about 20 N without magnetic field and with a magnetic field either oriented across the ribbon width (transverse field annealing) and oriented perpendicular to the ribbon plane (perpendicular field annealing).

| annealing conditions | $H_k$ (Oe) | $H_{max}$ (Oe) | $A1_{Hmax}$ (nWb) | $\lvert df_r/dH \rvert$ (Hz/Oe) | $H_{min}$ (Oe) | $A1_{Hmin}$ (nWb) |
|---|---|---|---|---|---|---|
| no magnetic field | 9.3 | 6.2 | 3.5 | 700 | 8.0 | 3 |
| perpendicular field | 10.5 | 6.5 | 3.4 | 795 | 9.0 | 2.7 |
| transverse field | 10.7 | 6.3 | 3.3 | 805 | 9.0 | 1.8 |

| F (N) | $H_k$ (Oe) | $H_{max}$ (Oe) | $A1_{Hmax}$ (nWb) | $t_{R,Hmax}$ (ms) | $\lvert df_r/dH \rvert$ (Hz/Oe) | $H_{min}$ (Oe) | $A1_{Hmin}$ (nWb) | $t_{r,Hmin}$ (ms) |
|---|---|---|---|---|---|---|---|---|
| 0 | 4.6 | 5.3 | 1.0 | 2.3 | 3132 | 4.1 | 0.9 | 1.2 |
| 11 | 8.9 | 5.5 | 3.8 | 4.1 | 1121 | 7.8 | 2.7 | 2.6 |
| 13 | 9.9 | 6.3 | 3.7 | 4.8 | 944 | 8.8 | 2.4 | 2.7 |
| 19 | 12.2 | 8.3 | 3.3 | 5.5 | 665 | 10.5 | 2.6 | 3.5 |
| 20 | 12.9 | 8.8 | 3.3 | 6.0 | 599 | 11.0 | 2.7 | 4.1 |

TABLE V (Comparative examples)

Magneto-acoustic properties of alloys No. 1 through 4 listed in Table I after annealing for 6 s at 360° C. under a tensile force of strength F in a magnetic field oriented perpendicular to the ribbon plane.

| Alloy No. | $H_k$ (Oe) <0.5 N | F (N) | $H_k$ (Oe) at F | $dH_k/d\sigma_{(Oe/MPa)}$ | $H_{max}$ (Oe) | $A1_{Hmax}$ (nWb) | $\lvert df/dH \rvert$ (Hz/Oe) | $H_{min}$ (Oe) | $A1_{Hmin}$ (nWb) |
|---|---|---|---|---|---|---|---|---|---|
| 1 | 7.4 | 13 | 9.9 | 0.028 | 6.5 | 3.8 | 622 | 8.5 | 3.1 |
| 2 | 4.2 | 18 | 9.7 | 0.032 | 6.5 | 3.3 | 490 | 7.9 | 2.8 |

TABLE V-continued (Comparative examples)
Magneto-acoustic properties of alloys No. 1 through 4 listed in Table I after annealing for 6 s at 360° C. under a tensile force of strength F in a magnetic field oriented perpendicular to the ribbon plane.

| Alloy No. | $H_k$ (Oe) <0.5 N | F (N) | $H_k$ (Oe) at F | $dH_k/d\sigma_{(Oe/MPa)}$ | $H_{max}$ (Oe) | $A1_{Hmax}$ (nWb) | \|df/dH\| (Hz/Oe) | $H_{min}$ (Oe) | $A1_{Hmin}$ (nWb) |
|---|---|---|---|---|---|---|---|---|---|
| 3 | 4.8 | 11 | 4.3 | −0.005 | 6.0 | 0.6 | 1423 | 4.0 | 0.3 |
| 4 | (*) | 11 | (*) | (*) | 5.5 | 0.55 | 16 | 5.8 | 0.53 |

(*) non-linear B-H loop

TABLE VI (Inventive examples)
Magneto-acoustic properties of alloys No. 5 through 17 listed in Table I after annealing for 6 s at 360° C. under a tensile force of 20 N in a magnetic field oriented perpendicular to the ribbon plane

| Alloy No. | $H_k$ (Oe) <0.5 N | $H_k$ (Oe) 20 N | $\|dH_k/d\sigma\|$ (Oe/MPa) | $H_{max}$ (Oe) | $A1_{Hmax}$ (nWb) | \|df/dH\| (Hz/Oe) | $H_{min}$ (Oe) | $A1_{Hmin}$ (nWb) |
|---|---|---|---|---|---|---|---|---|
| 5 | 4.3 | 6.4 | 0.014 | 3.3 | 1.7 | 1225 | 5.5 | 1.0 |
| 6 | 3.7 | 6.7 | 0.017 | 2.8 | 2.4 | 1271 | 5.8 | 1.3 |
| 7 | 3.3 | 6.4 | 0.020 | 4.0 | 2.1 | 728 | 5.4 | 1.8 |
| 8 | 3.6 | 10.3 | 0.042 | 6.5 | 2.9 | 632 | 8.8 | 2.0 |
| 9 | 6.4 | 11.4 | 0.036 | 7.5 | 4.0 | 755 | 10.0 | 2.7 |
| 10 | 5.5 | 10.9 | 0.037 | 6.5 | 3.7 | 853 | 9.3 | 2.2 |
| 11 | 4.4 | 8.6 | 0.027 | 4.5 | 3.4 | 996 | 7.5 | 1.7 |
| 12 | 4.3 | 10.5 | 0.042 | 6.5 | 3.4 | 795 | 9.0 | 2.7 |
| 13 | 4.6 | 12.9 | 0.056 | 8.8 | 3.3 | 599 | 11.0 | 2.7 |
| 14 | 3.9 | 9.5 | 0.036 | 6.8 | 3.3 | 614 | 8.3 | 2.9 |
| 15 | 5.1 | 12.4 | 0.052 | 9.8 | 2.6 | 177 | 11.3 | 2.4 |
| 16 | 7.7 | 12.1 | 0.033 | 7.3 | 4.1 | 867 | 10.3 | 2.4 |
| 17 | 4.8 | 10.6 | 0.037 | 6.5 | 3.5 | 765 | 9.0 | 2.9 |
| 18 | 3.6 | 11 | 0.050 | 7.0 | 3.1 | 634 | 9.2 | 1.8 |
| 19 | 3.4 | 11.5 | 0.054 | 7.5 | 2.7 | 505 | 9.7 | 1.8 |
| 20 | 3.0 | 11.5 | 0.058 | 7.8 | 2.2 | 351 | 10.0 | 1.7 |
| 21 | 2.9 | 11.2 | 0.057 | 8.0 | 1.7 | 182 | 10.0 | 1.2 |

Although modifications and changes may be suggested by those skilled in the art, it is the intention of the inventor to embody within the patent warranted hereon all changes and modifications as reasonably and properly come within the scope of his contribution to the art.

We claim:

1. A method of annealing a magnetic amorphous alloy article comprising the steps of:

(a) providing an unannealed amorphous alloy article having an alloy composition and a longitudinal axis;

(b) disposing said unannealed amorphous alloy article in a zone of elevated temperature while subjecting said amorphous alloy article to a tensile force along said longitudinal axis, and without a magnetic field other than an ambient magnetic field, to produce an annealed article; and (c) selecting said alloy composition to comprise at least iron and nickel and at least one element from the group consisting of V, Nb, Ta, Cr, Mo and W so that the annealed article has an induced magnetic easy plane perpendicular to said longitudinal axis due to a combination of said composition, said temperature and said tensile stress.

2. A method as claimed in claim 1 wherein step (a) comprises providing a continuous, unannealed amorphous alloy ribbon as said unannealed amorphous alloy article, and wherein step (b) comprises continuously transporting said ribbon through said zone of elevated temperature.

3. A method as claimed in claim 2 wherein said annealed article has a magnetic property, and wherein step (b) comprises adjusting said tensile stress in a feedback control loop to adjust said magnetic property to a specified value.

4. A method as claimed in claim 1 wherein step (b) comprises annealing said amorphous alloy article to give said annealed article a magnetic behavior characterized by a hysteresis loop which is linear up to a magnetic field which ferromagnetically saturates said annealed article.

5. A method of annealing a magnetic amorphous alloy article comprising the steps of:

(a) providing an unannealed amorphous alloy ribbon having a width between about 1 mm and about 14 mm and a thickness between about 15 $\mu$m and about 40 $\mu$m (b) disposing said unannealed amorphous alloy article in a zone of elevated temperature while subjecting said amorphous alloy to a tensile force along said longitudinal axis, and without a magnetic fields other than an ambient magnetic field, to produce an annealed article; and (c) selecting said alloy composition to comprise at least iron and nickel and at least one element from the group consisting of V, Nb, Ta, Cr, Mo and W so that the annealed article has an induced magnetic easy plane perpendicular to said longitudinal axis due to said tensile stress selecting said alloy composition such that said annealed article has a ductility allowing said annealed article to be cut into discrete elongated strips.

6. A method of making a marker for use in magnetomechanical electronic article surveillance system, comprising the steps of:

(a) providing at least one unannealed amorphous alloy article having an alloy composition and a longitudinal axis;

(b) disposing said at least one unannealed amorphous alloy article in a zone of elevated temperature while subjecting said at least one amorphous alloy article to a tensile force along said longitudinal axis, and without a magnetic field other than an ambient magnetic field to produce at least one annealed article;

(c) selecting said alloy composition to comprise at least iron and nickel and at least one element from the group consisting of V, Nb, Ta, Cr, Mo and W to produce in said at least one annealed article, in combination with said temperature and said tensile stress, an induced magnetic easy plane perpendicular to said longitudinal axis due to said tensile stress;

(d) placing said at least one annealed article adjacent a magnetized ferromagnetic bias element which produces a bias magnetic field; and (e) encapsulating said at least one annealed article and said bias element in a housing.

7. A method as claimed in claim 6 wherein step (d) comprises placing two of said annealed articles in registration adjacent said magnetized ferromagnetic bias element, and wherein step (e) comprises encapsulating said two annealed articles and said bias element in said housing.

8. A method as claimed in claim 6 wherein step (a) comprises providing a continuous, unannealed amorphous alloy ribbon as said at least one unannealed amorphous alloy article, and wherein step (b) comprises continuously transporting said ribbon through said zone of elevated temperature.

9. A method as claimed in claim 8 wherein said annealed article has a magnetic property, and wherein step (b) comprises adjusting said tensile stress in a feedback control loop to adjust said magnetic property to a specified value.

10. A method as claimed in claim 6 wherein step (b) comprises annealing said at least one amorphous alloy article to give said at least one annealed article a magnetic behavior characterized by a hysteresis loop which is linear up to a magnetic field which ferromagnetically saturates said annealed article.

11. A method of annealing and amorphous alloy article comprising the steps of:

providing an unannealed amorphous alloy article having a longitudinal axis and an alloy composition selected to produce a stress-induced anisotropy greater than 0.04 Oe/MPa in said amorphous alloy article when said amorphous alloy article is annealed for six seconds at 360° C. and selected to produce a magnetic easy axis perpendicular to said longitudinal axis when a tensile stress is applied along said longitudinal axis during annealing; and disposing said amorphous alloy article in a zone of elevated temperature, and without a magnetic field other than an ambient magnetic field, while subjecting said amorphous alloy article to a tensile force along said longitudinal axis to produce said anisotropy greater than 0.04 Oe/MPa and said magnetic easy axis in said amorphous alloy article.

12. A method as claimed in claim 11 comprising the step of selecting said alloy composition to produce a stress-induced anisotropy of greater than 0.05 Oe/MPa in said amorphous alloy article when annealed for six seconds at 360° C.

13. A method as claimed in claim 11 wherein the step of disposing said amorphous alloy article in a zone of elevated temperature comprises disposing said amorphous alloy in a zone of elevated temperature having a temperature profile with a maximum temperature between about 300° C. and about 420° C. for less than one minute.

14. A method as claimed in claim 11 wherein the step of providing an unannealed amorphous alloy article comprises providing an unannealed amorphous alloy article having a cobalt content of less than about 4 at %.

* * * * *